US006739684B1

(12) United States Patent
Askeland et al.

(10) Patent No.: US 6,739,684 B1
(45) Date of Patent: May 25, 2004

(54) BURST MODE PRINTING TO COMPENSATE FOR COLORANT MIGRATION

(75) Inventors: Ronald A. Askeland, San Diego, CA (US); Jason R. Arbeiter, Poway, CA (US); Isabel Borrell Bayona, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/284,688

(22) Filed: Oct. 31, 2002

(51) Int. Cl.[7] ..... B41J 29/38; B41J 2/205
(52) U.S. Cl. ..... 347/9; 347/11; 347/15
(58) Field of Search ..... 347/9, 11, 15, 347/57, 10

(56) References Cited

U.S. PATENT DOCUMENTS 6,193,347 B1 * 2/2001 Askeland et al. ..... 347/15
6,302,505 B1 10/2001 Askeland et al.

* cited by examiner

*Primary Examiner*—Michael S Brooke

(57) ABSTRACT

Within a printer, compensation is provided for color migration within ink drops. Color compensation is provided by varying firing frequency of each print nozzle so as to fire high frequency bursts of ink drops. Each print nozzle is idle, not being used to eject ink drops, between high frequency bursts of ink drops.

31 Claims, 10 Drawing Sheets

BURST MODE PRINTING TO COMPENSATE FOR COLORANT MIGRATION

BACKGROUND

Inkjet printing mechanisms use moveable cartridges, also called pens, that use one or more printheads formed with very small nozzles through which drops of liquid ink (e.g., dissolved colorants or pigments dispersed in a solvent) are fired. To print an image, the carriage traverses over the surface of the print medium, and the ink ejection elements associated with the nozzles are controlled to eject drops of ink at appropriate times pursuant to command of a microcomputer or other controller. The pattern of pixels on the print media resulting from the firing of ink drops results in the printed image. Certain ink jet inks undergo a process of colorant migration wherein the colorant in the firing chamber is depleted over a short time period. Colorant migration causes print quality defects, especially in documents with fine lines and narrow text characters.

For ink jet inks that undergo a process of colorant migration, delay between firing drops from a nozzle, allows the migration to occur. Thus after a 1.5 second period of non-printing, a drop of black ink can have a shading more like gray than black. After about a 3 second period of non-printing, a drop of black ink can lose most of the colorant and appear almost clear.

The problem of colorant migration is diminished with larger drop volumes. For example, for print cartridges that eject drops that are 30 nanograms (ng) or larger, the large drop weight makes colorant migration less noticeable. However, writing systems that use large drop volumes have significantly worse image quality than those with lower drop weights.

Continuous firing of a print nozzle at high frequency also serves to significantly diminish the effects of colorant migration. For example, the HP Business InkJet 2200 printer, available from Hewlett-Packard Company, having a business address of 3000 Hanover Drive, Palo Alto, Calif. 94304, uses smaller (lower drop weight) 18 ng black drops fired at 36 kilohertz (kHz) from a 600 nozzles per inch (npi) cartridge. However, continuous firing at 36 kHz can cause the printhead to over heat, can cause drop ejection problems and puts constraints on the fluidic architecture design.

SUMMARY OF THE INVENTION

In accordance with the preferred embodiment of the present invention, within a printer, compensation is provided for color migration within ink drops. Color compensation is provided by varying firing frequency of each print nozzle so as to fire high frequency bursts of ink drops. Each print nozzle is idle, not being used to eject ink drops, between high frequency bursts of ink drops.

DESCRIPTION OF THE PREFERRED EMBODIMENT

Figure 1:
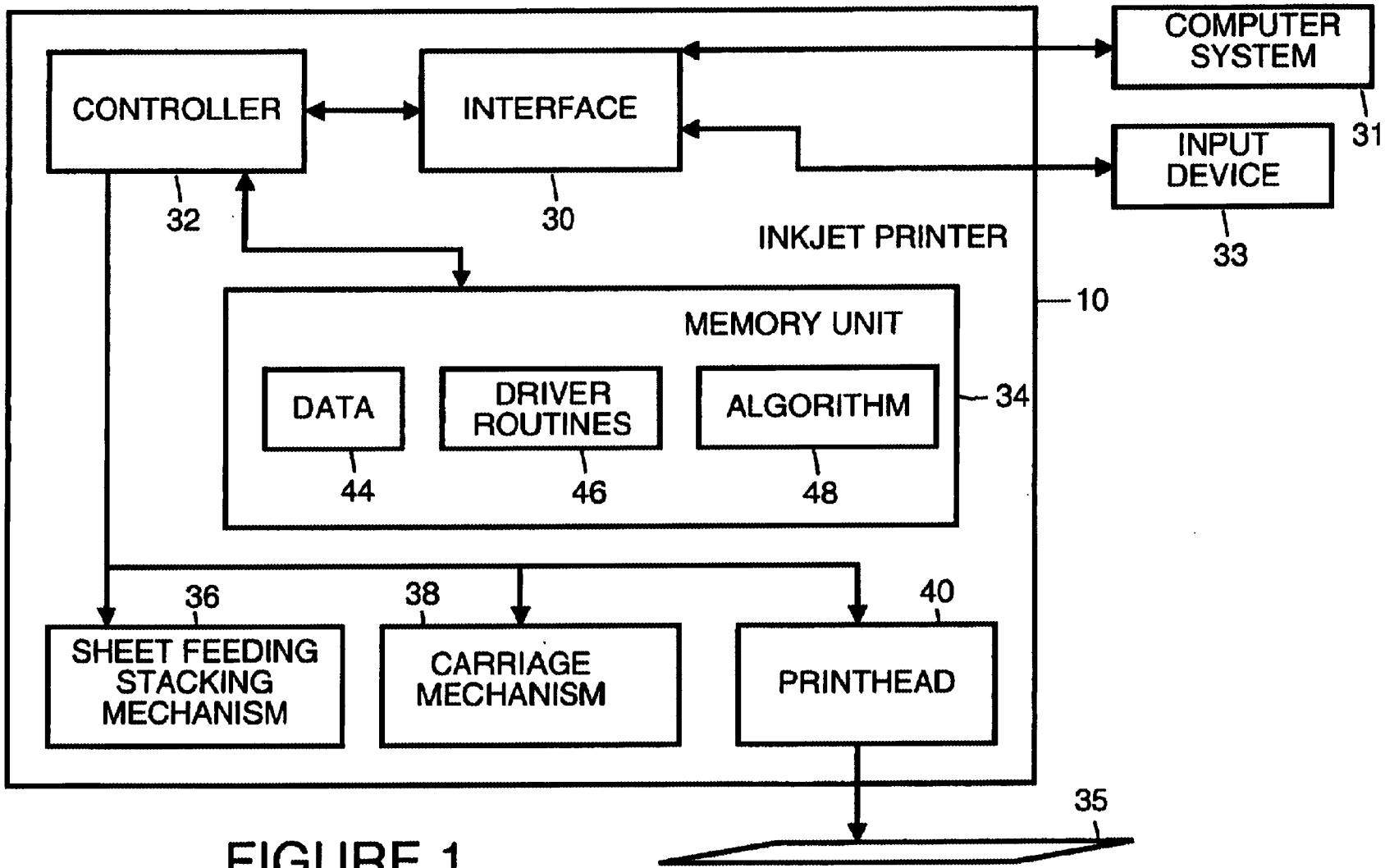
FIG. 1 is a simplified block diagram of an inkjet printer according to an embodiment of the present invention.

FIG. 1 is a simplified block diagram of an inkjet printer 10. Inkjet printer 10 includes, for example, a controller 32 that is connected to a computer system 31 via an interface unit 30. The interface unit 30 facilitates the transferring of data and command signals to controller 32 for printing purposes. Interface unit 30 also enables inkjet printer 10 to be electrically connected to an input device 33 for the purpose of downloading print image information to be printed on a print medium 35. Input device 33 can be any type of peripheral device (e.g., a scanner or fax machine) that can be connected to inkjet printer 10.

In order to store the data, at least temporarily, inkjet printer 10 includes a memory unit 34. Memory unit 34 is divided into a plurality of storage areas that facilitate printer operations. The storage areas include a data storage area 44, driver routines storage 46, and algorithm storage area 48 that holds the algorithms that facilitate the mechanical control implementation of the various mechanical mechanisms of inkjet printer 10.

Data area 44 receives data files that define the individual pixel values that are to be printed to form a desired object or textual image on medium 35. Driver routines 46 contain printer driver routines. Algorithms 48 include the routines that control a sheet feeding stacking mechanism for moving a medium through the printer from a supply or feed tray to an output tray and the routines that control a carriage mechanism that causes a printhead carriage unit to be moved across a print medium on a guide rod.

In operation, inkjet printer 10 responds to commands by printing full color or black print images on print medium 35. In addition to interacting with memory unit 34, controller 32 controls a sheet feeding stacking mechanism 36 and a carriage mechanism 38. Controller 32 also forwards printhead firing data to one or more printheads, represented in FIG. 1 by a printhead 40. The input data received at interface 30 includes, for example, information describing printed characters and/or images for printing. For example, input data may be in a printer format language such as Postscript, PCL 3, PCL 5, HPGL, HPGL 2 or some related version of these. Alternatively, the input data may be formatted as raster data or formatted in some other printer language. The printhead firing data sent to printhead 40 is used to control the ejection elements associated with the nozzles of an ink jet printer, such as for thermal ink jet printer, piezo ink jet printers or other types of ink jet printers.

Figure 2:
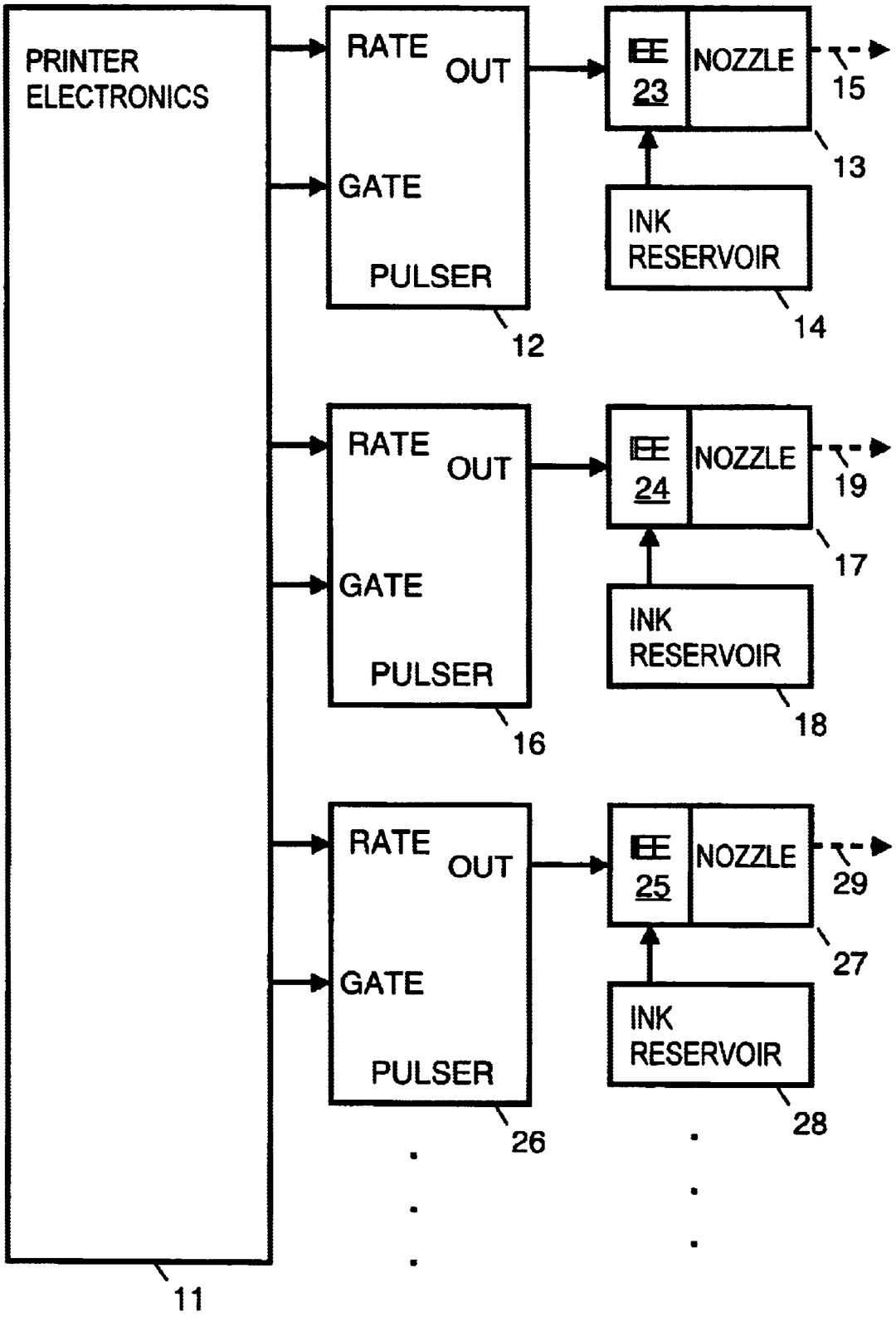
FIG. 2 is a simplified block diagram of print electronics within the inkjet printer shown in FIG. 1.

For example, as shown in FIG. 2, printhead firing data is used by a pulser 12 to generate pulses that control an ink ejection element (IEE) 23 associated with a nozzle 13 located on a printhead 40. Pulser 12 may be located on or off printhead 40, depending on the particular embodiment of the present invention. In the example shown in FIG. 2, printer electronics 11 provides to pulser 12 printhead firing data on two lines. Information on the first line sets the pulse rate and information on the second line indicates which pulses are to be forwarded to ink ejection element 23. The pulses forwarded to ink ejection element 23 are forwarded as a current pulse that is applied to a resistor within ink ejection element 23. The current pulse causes an ink droplet 15, formed with ink from an ink reservoir 14, to be emitted from nozzle 13.

Printhead firing data generated by controller 32 is also used by a pulser 16 to generate pulses which control an ink ejection element (IEE) 24 associated with a nozzle 17. Controller 32 provides to pulser 16 printhead firing data on two lines. Information on the first line sets the pulse rate and information on the second line indicates which pulses are to be forwarded to ink ejection element 24. The pulses forwarded to ink ejection element 24 are forwarded as a current pulse that is applied to a resistor within ink ejection element 24. The current pulse causes an ink droplet 19, formed with ink from an ink reservoir 18, to be emitted from nozzle 17. Nozzle 17 can be located on printhead 40 or on another printhead.

The printhead firing data is also used by a pulser 26 to generate pulses which control an ink ejection element (IEE) 25 associated with a nozzle 27. Controller 32 provides to pulser 26 printhead firing data on two lines. Information on the first line sets the pulse rate and information on the second line indicates which pulses are to be forwarded to ink ejection element 25. The pulses forwarded to ink ejection element 25 are forwarded as a current pulse that is applied to a resistor within ink ejection element 25. The current pulse causes an ink droplet 29, formed with ink from an ink reservoir 28, to be emitted from nozzle 27. Nozzle 27 can be located on printhead 40 or on another printhead.

For more information on inkjet printers, see for example U.S. Pat. No. 6,302,505, issued on Oct. 16, 2001 to Askeland et al. for "Printing System that Utilizes Continuous and Non-continuous Firing Frequencies", which is commonly assigned and the subject matter of which is herein incorporated by reference.

Figure 3:
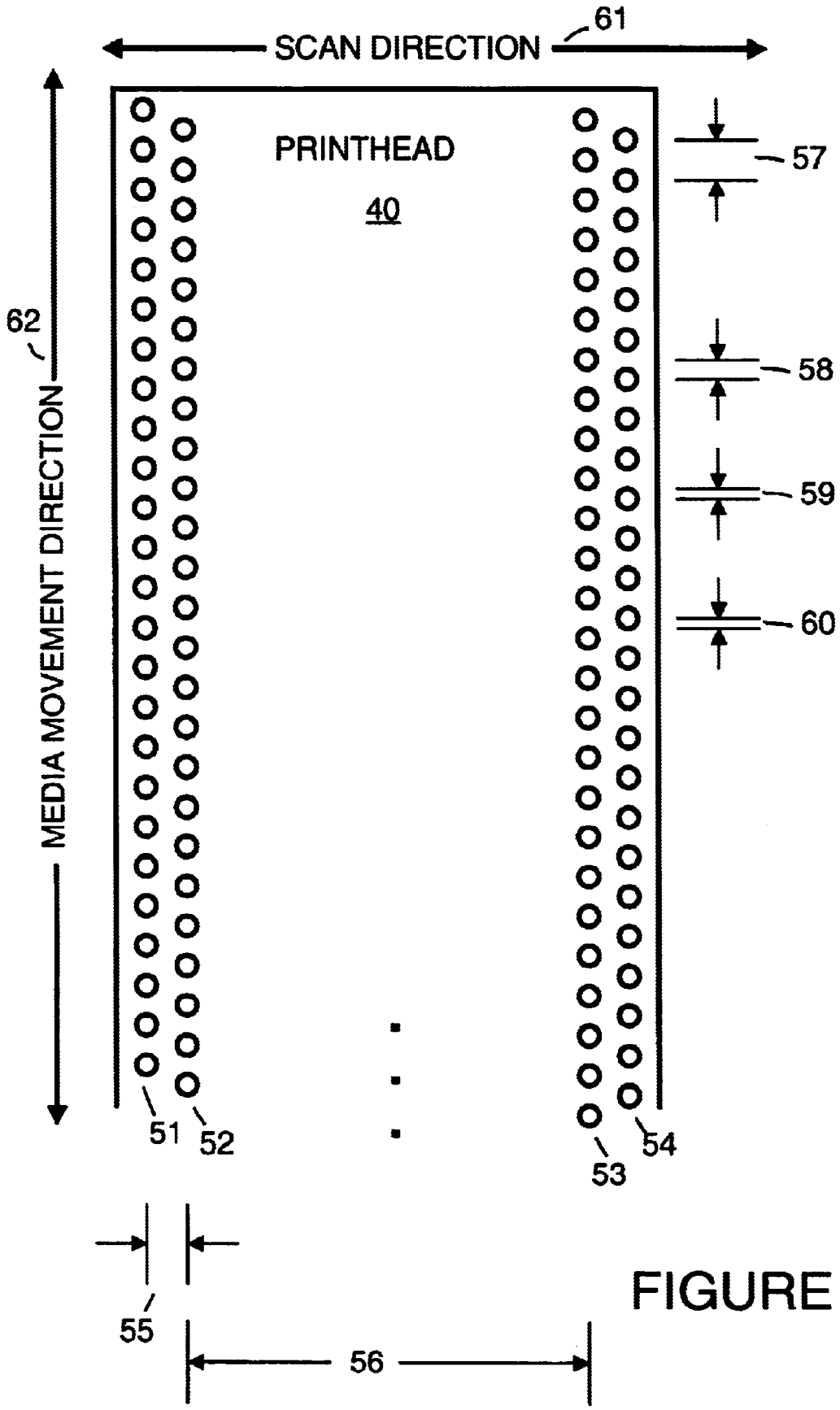
FIG. 3 is a simplified diagram (not to scale) of a printhead used with the inkjet printer shown FIG. 1.

FIG. 3 is a simplified diagram (not to scale) showing the arrangement of a portion of the nozzles of printhead 40. For example, printhead 40 has four vertical columns of nozzles. These are represented in FIG. 3 by a vertical column 51 of nozzles, a vertical column 52 of nozzles, a vertical column 53 of nozzles and a vertical column 54 of nozzles. For example, vertical column 51 of nozzles is separated from vertical column 52 of nozzles by a distance 55 of approximately 0.2 millimeters. For example, vertical column 52 of nozzles is separated from vertical column 53 of nozzles by a distance 56 of approximately 1.9 millimeters.

The vertical columns of nozzles are perpendicular to a scan direction 61 and parallel to a media movement direction 62. The columnar vertical spacing 57 between adjacent nozzles in a column is, for example, $1/600$th inch. By using four columns of nozzles instead of one, and logically treating the nozzles as a single column, the effective vertical spacing (represented in FIG. 3 by a distance 59 and a distance 60) is reduced to $1/2400^{th}$ inch, thus achieving improved printing resolution in direction of the media advance direction 92. Distance 58, equal to $1/1200^{th}$ of an inch, represents the columnar vertical spacing 57 between adjacent nozzles in vertical column 53 and vertical column 54. For example, vertical column 51, vertical column 52, vertical column 53 and vertical column 54 each have 528 nozzles, for a total of 2112 nozzles. The number of nozzles may be arbitrarily selected.

Printing can be performed in one or multiple passes. Some printers utilize print modes to vary the number of passes used for printing. One pass operation facilitates increased throughput on plain paper. In a one-pass mode, all dots to be fired on a given row of dots are placed on the medium in one swath of the printhead, and then the print medium is advanced into position for the next swath. A two-pass print mode is a print pattern wherein approximately one-half of the dots available for a given row of available dots per swath are printed on each pass of the printhead, so two passes are needed to complete the printing for a given row. Similarly, a four-pass mode is a print pattern wherein approximately one fourth of the dots for a given row are printed on each pass of the printhead. In a print mode of a certain number of passes, each pass should print, of all the ink drops to be printed, a fraction equal roughly to the reciprocal of the number of passes.

Print modes are also used to determine specific partial-inking patterns. Print modes also allow the printer to control several factors during printing that influence image quality, including the amount of ink placed on the media per dot location, the speed with which the ink is placed, and the number of passes required to complete the image. Providing different print modes to allow placing ink drops in multiple swaths can help with hiding nozzle defects. Different print modes are also employed depending on the media type.

The pattern used in printing each nozzle section is known as a "print mask." Typically, if more than one pass is used to print, a different print mask is used for each pass. During multipass printing, a print mask is a binary pattern that determines exactly which ink drops are printed in a given pass. In other words, a print mask determines which passes are used to print each pixel. Thus, the print mask defines both the pass and the nozzle which will be used to print each pixel location, i.e., each row number and column number on the media. The print mask can be used to "mix up" the nozzles used in such a way as to reduce undesirable visible printing artifacts. In single pass printing and in multiple pass printing, a print mask can be used to reduce the firing frequency of each nozzle.

Print controller 32 (shown in FIG. 1) controls carriage mechanism 38 and media 35 movements and activates the nozzles for ink drop deposition. By combining the relative movement of the carriage mechanism 38 along the scan direction 61 with the relative movement of the print medium 35 along the medium movement direction 62, each printhead 40 can deposit one or more drops of ink at each individual one of the pixel locations on the print medium 35. A print mask is used by print controller 32 to govern the deposition of ink drops from the printhead 40. For example, a separate print mask may exist for each discrete intensity level of color (e.g. light to dark) supported by inkjet printer 10. For each pixel position in a row during an individual printing pass, the print mask has a print mask pattern which acts both to enable the nozzle positioned adjacent the row to print, or disable that nozzle from printing, on that pixel location, and to define the number of drops to be deposited from enabled nozzles. Whether or not the pixel will actually be printed on by the corresponding enabled nozzle depends on whether the image data to be printed requires a pixel of that ink color in that pixel location. The print mask is typically implemented in firmware in inkjet printer 10, although it can be alternatively implemented in a software driver in a computing processor (not shown) external to the printer.

The term "printing pass", as used herein, refers to those passes in which printhead 40 is enabled for printing as the nozzle arrangement moves relative to the medium 35 in the scan direction 61. In bi-directional printing, each forward and rearward pass along the scan direction 61 can be a printing pass. In unidirectional printing, printing passes can occur in only one of the directions of movement. In a given printing pass of the carriage mechanism 38 over the print medium 35 in a multi-pass printer, only the certain pixel locations enabled by the print mask can be printed, and inkjet printer 10 deposits the number of drops specified by the print mask for the corresponding pixel locations if the image data so requires. The print mask pattern is such that additional drops for the certain pixel locations, as well as drops for other pixel locations in the swath, are filled in during other printing passes.

Figure 4:
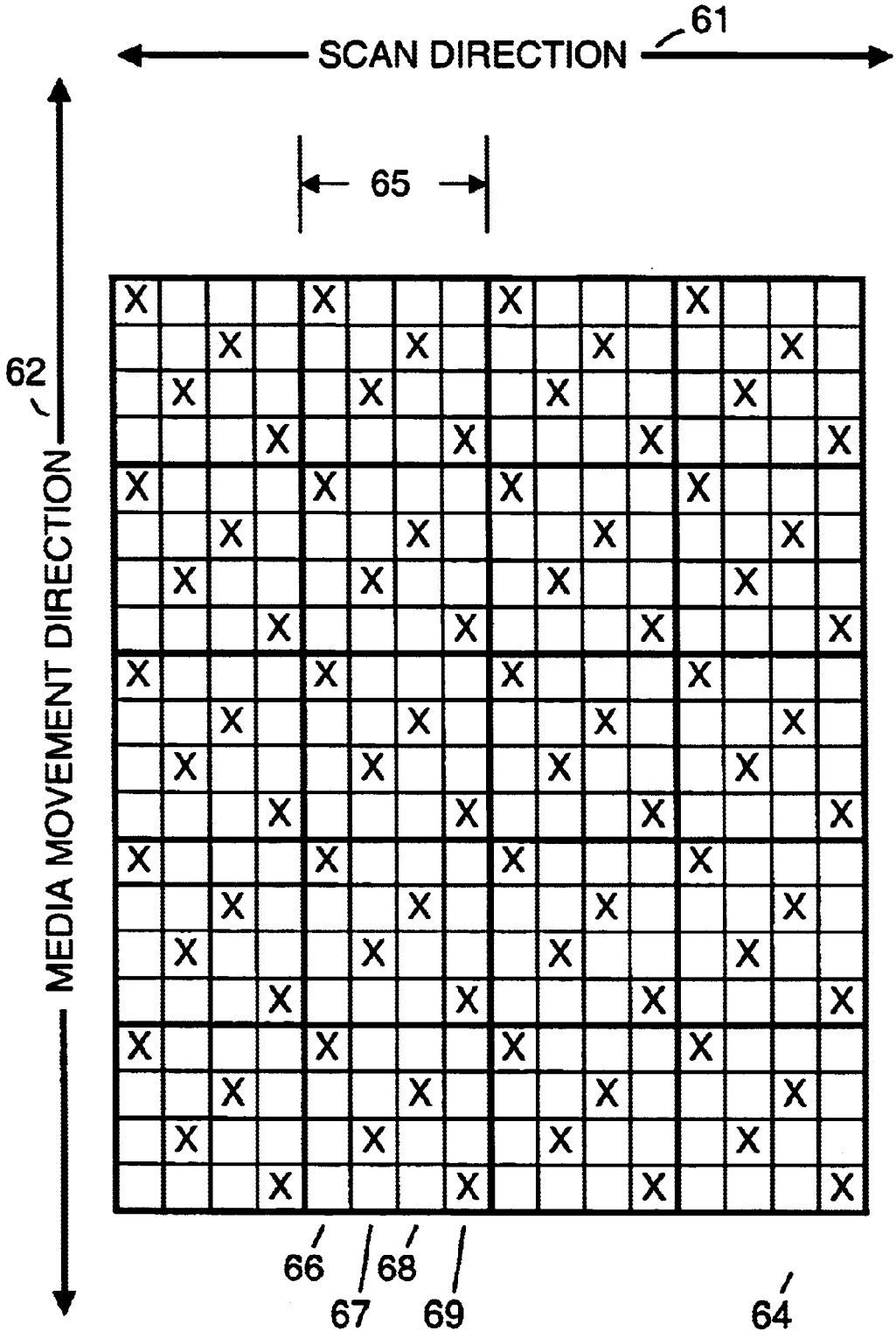
FIG. 4 shows a print mask used within the inkjet printer shown in FIG. 1.

FIG. 4 shows an example of a portion of a printing mask 64 used for single pass printing with a 2400 nozzles per inch (npi), 18 nanogram (ng) print cartridge. The print mask can be used for any color (including black) ink utilized by a printer. Each small rectangle represents a 1/1200 inch wide by 1/2400 inch tall pixel. An "X" indicates where a drop is made on the media.

Each row represents the firing pattern of a single nozzle. The printing mask shown in FIG. 4 spreads out the firing of nozzles to give the lowest firing frequency. In any 4×4 matrix of printing mask 64, each nozzle can fire at most 1 time. For example, printing mask 64 in FIG. 4 would have a maximum firing frequency of 9 kHz at a 30 inch per second (ips) scan rate.

In order to print a 1/300 inch wide line indicated by width 65, drops in a column 66, a column 67, a column 68 and a column 69 are used. Within width 65, each nozzle is fired at most one time per pass. If the nozzles used to print the line delineated by width 65 are idle for a significant length of time (e.g., more than a one second delay) before beginning to print the line delineated by width 65, color depletion of ink drops can have a significant impact on the print quality of the line.

A solution to the print quality problem caused by color depletion of ink drops is to use a mask that allows for the firing of a 2 drop burst at high frequency. This is illustrated in FIG. 5.

Throughout the descriptions of the Figures, vertical lines are used as printing examples. As will be understood by persons of ordinary skill in the art, the print quality issues that arise printing vertical lines arise when printing other shapes and so the use of vertical lines is merely exemplary.

Figure 5:
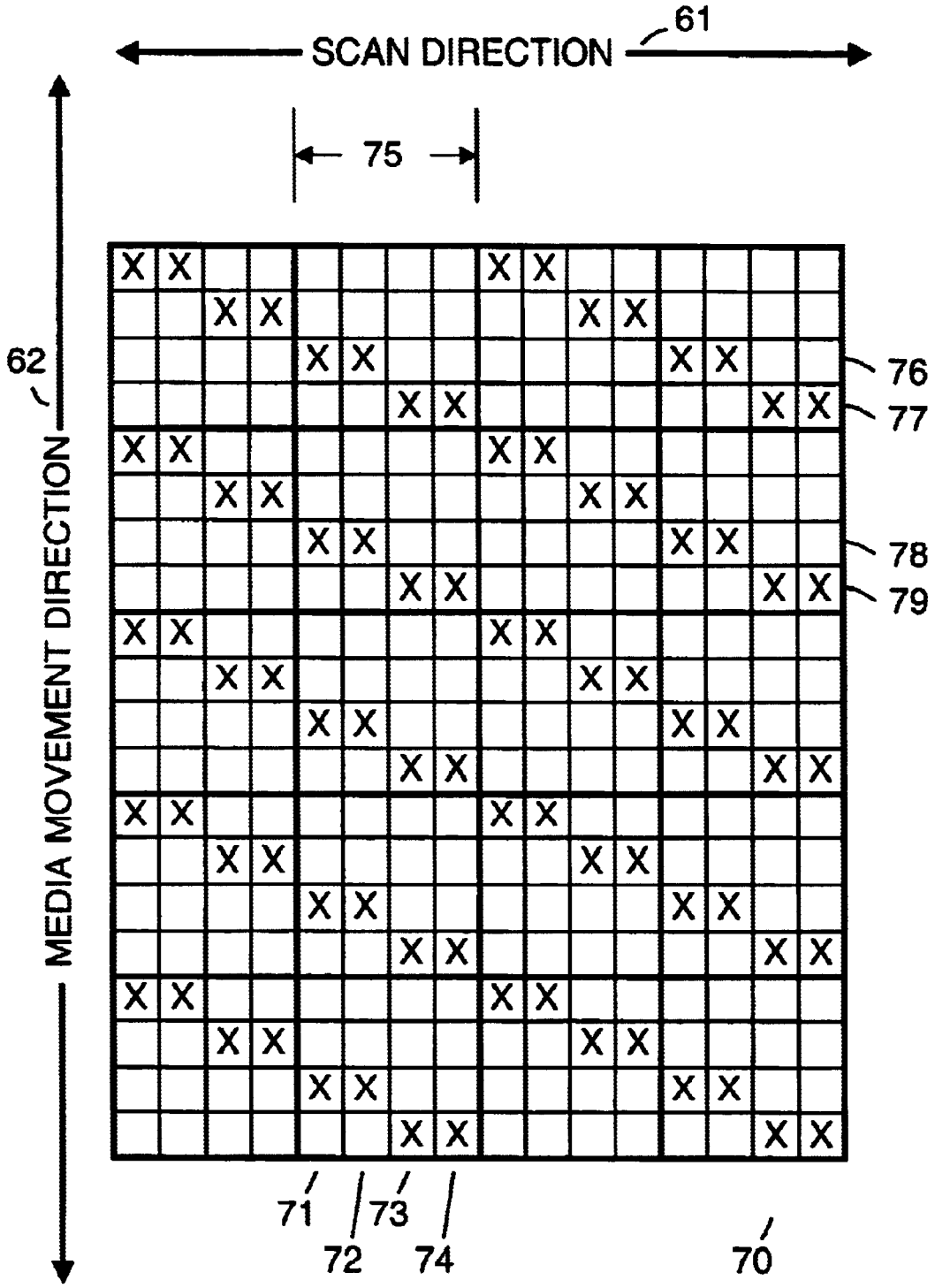
FIG. 5 shows a print mask used within the inkjet printer shown in FIG. 1 in accordance with an embodiment of the present invention.

FIG. 5 shows an example of a portion of a printing mask 70 used for single pass printing with a 2400 nozzles per inch (npi), 18 nanogram (ng) print cartridge. Each small rectangle represents a 1/1200 inch wide by 1/2400 inch tall pixel. The printing mask shown in FIG. 5 includes two drop burst firing of nozzles. In any 4×4 matrix of printing mask 70, at least one nozzle fires twice in succession.

In order to print a 1/300 inch wide line indicated by width 75, drops in a column 71, a column 72, a column 73 and a column 74 are used. Within width 75, half the nozzles are fired twice per pass. If the nozzles used to print the line delineated by width 75 are idle for a significant length of time (e.g., more than a one second delay) before beginning to print the line delineated by width 75, color depletion of ink drops can result in color depletion of the first drop fired by the nozzle. However the second drop in the two drop burst fired by the nozzle will not be color depleted. For example, the colorant in the ink can be any color, including black, used by a printer.

For example, the nozzle represented by a row 76 may fire a color depleted drop in column 71, but will fire a full colorant drop in column 72. Likewise, the nozzle represented by a row 77 may fire a color depleted drop in column 73, but will fire a full colorant drop in column 74. The nozzle represented by a row 78 may fire a color depleted drop in column 71, but will fire a full colorant drop in column 72. The nozzle represented by a row 79 may fire a color depleted drop in column 73, but will fire a full colorant drop in column 74. This will result in a vertical line that is composed of 50% potentially depleted and 50% full colorant drops.

Figure 6:
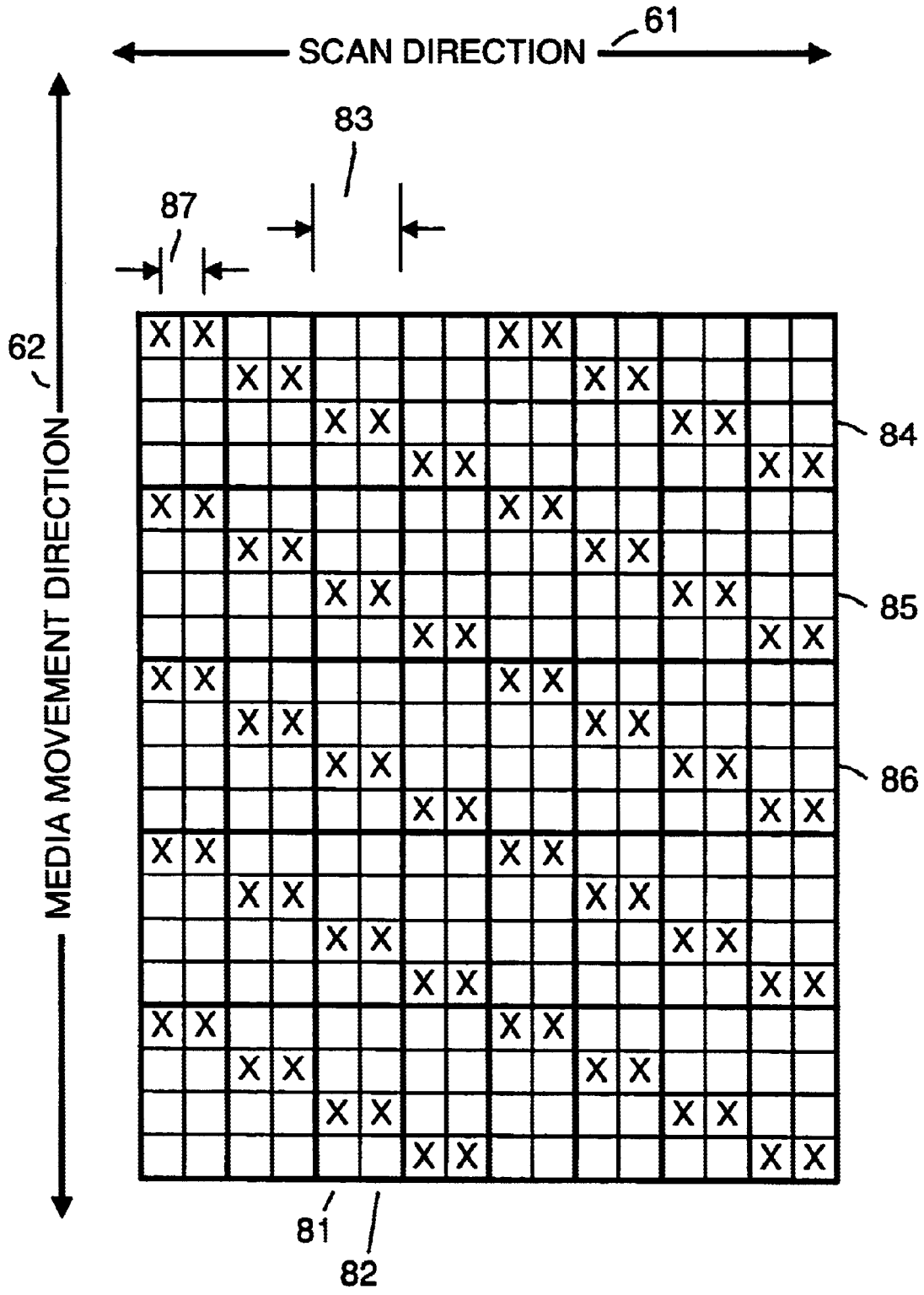
FIG. 6 shows a print mask used within the inkjet printer shown in FIG. 1 in accordance with an embodiment of the present invention.

As illustrated by FIG. 6, a 1/600 inch wide line can also be printed with 50% depleted and 50% full colorant drops. FIG. 6 shows an example of a portion of a printing mask 80 used for single pass printing with a 2400 nozzles per inch (npi), 18 nanogram (ng) print cartridge. Each small rectangle represents a 1/1200 inch wide by 1/2400 inch tall pixel. The printing mask shown in FIG. 6 includes two drop burst firing of nozzles. Any 1/600 inch wide line of printing mask 80 will be composed of 50% potentially depleted and 50% full colorant drops. In FIG. 6, the horizontal resolution of printing is 600 dpi, so each nozzle will fire a two drop burst for every printed pixel.

In order to print a 1/600 inch wide line indicated by width 83, drops in a column 81 and a column 82 are used. Within width 83, one fourth of the nozzles are fired twice per pass. If the nozzles used to print the line delineated by width 83 are idle for a significant length of time (e.g., more than a one second delay) before beginning to print the line delineated by width 83, color depletion of ink drops can result in color depletion of the first drop fired by the nozzle. However, the second drop in the two drop burst fired by the nozzle will not be color depleted.

For example, the nozzle represented by a row 84 may fire a color depleted drop in column 81, but will fire a full colorant drop in column 82. Likewise, the nozzle represented by a row 85 may fire a color depleted drop in column 81, but will fire a full colorant drop in column 82. The nozzle represented by a row 86 may fire a color depleted drop in column 81, but will fire a full colorant drop in column 82. This will result in a vertical line that is composed of 50% potentially depleted and 50% full colorant drops.

In FIG. 6, higher frequency bursts or ink drops are separated by a period of time approximately equal to seven times a length of duration of each higher frequency burst of ink drops. This is illustrated in each row of FIG. 6 by two X's in immediately adjacent rectangles (representing, the higher frequency bursts of ink drops), followed by six rectangles without an X, before another X occurs in a seventh rectangle (representing the period of time approximately equal to seven times a length of duration of each higher frequency burst of ink drops). For example, the period (duration) of time for a higher frequency burst of ink drops to occur, as represented in FIG. 6, is the time from the beginning of when the first ink drop in the burst is fired, until the time the last ink drop in the burst has been fired. For a two-drop burst this is equal to the time it takes to fire the first ink drop, plus the time between firing the first ink drop and the second ink drop, plus the time it takes to fire the second ink drop. When the firing of an ink drop is considered to be almost instantaneous, then the period of time for a higher frequency burst of ink drops to occur is approximately equal to the time between firing the first ink drop and the second ink drop. This is represented in FIG. 6 by a duration 87. For example, duration 87 is shown based on an assumption that each ink drop is fired at a time location equivalent to the center of a rectangle. As can be seen from duration 87, the duration of time for a higher frequency burst of two ink drops to occur is approximately equal to the duration of time represented by one rectangle.

In FIG. 5 and FIG. 6, good line quality is achieved in both cases. This approach requires the printing of a 2 drop burst at 36 kHz which is much easier to accomplish than continuous firing at 36 kHz and typically does not cause the overheating and drop ejection problems of continuous printing.

Figure 7:
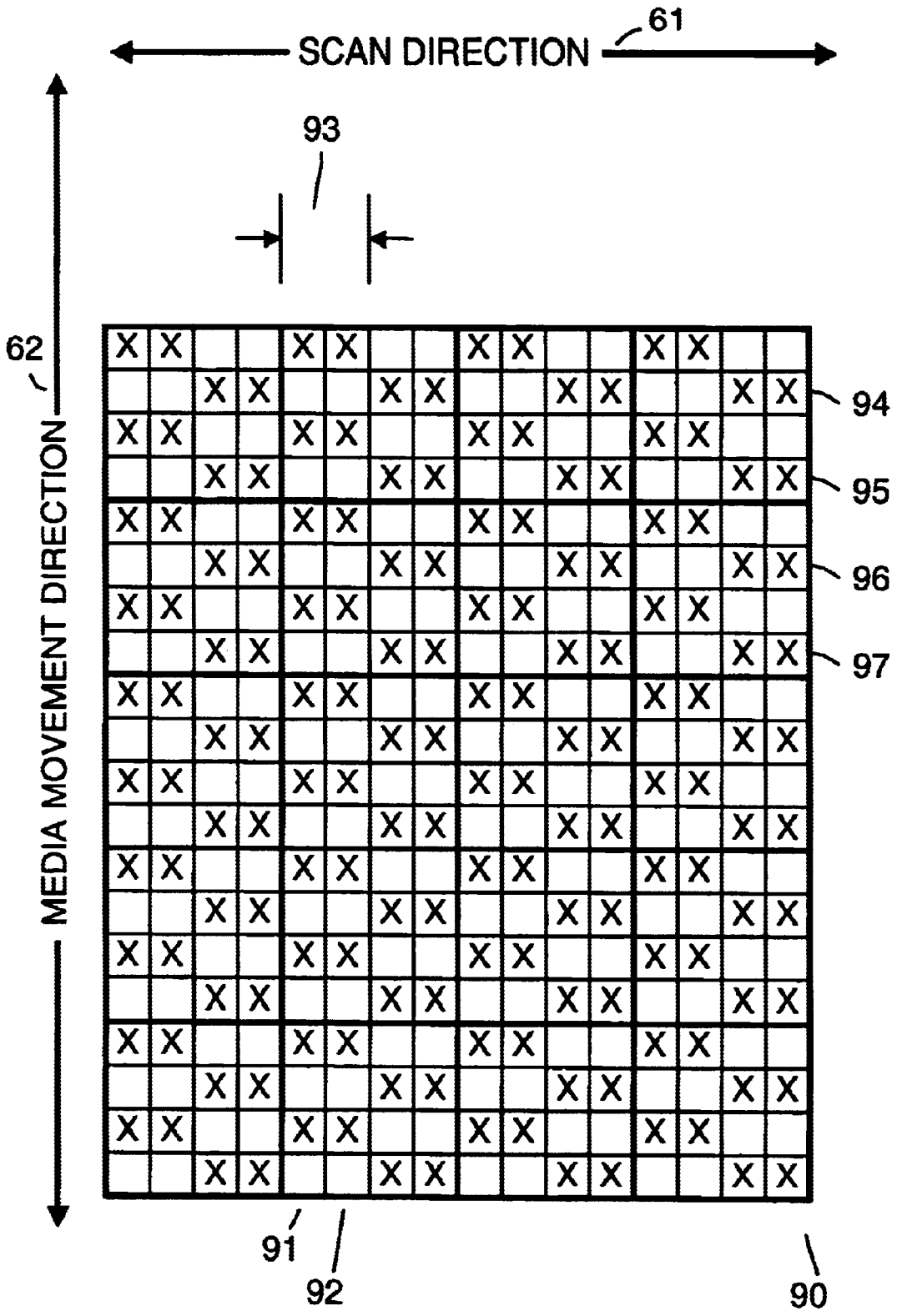
FIG. 7 shows a print mask used within the inkjet printer shown in FIG. 1 in accordance with an embodiment of the present invention.

FIG. 7 shows how good line quality can be achieved using a 2 drop burst with a 9 ng, 2400 npi writing system. (50% depleted drops and 50% full colorant drops). In order to print a 1/600 inch wide line indicated by width 93, drops in a column 91 and a column 92 are used. Within width 93, half the nozzles are fired twice per pass. If the nozzles used to print the line delineated by width 93 are idle for a significant length of time (e.g., more than a one second delay) before beginning to print the line delineated by width 93, color depletion of ink drops can result in color depletion of the first drop fired by the nozzle. However, the second drop in the two drop burst fired by the nozzle will not be color depleted.

For example, the nozzle represented by a row 94 may fire a color depleted drop in column 91, but will fire a full colorant drop in column 92. Likewise, the nozzle represented by a row 95 may fire a color depleted drop in column 91, but will fire a full colorant drop in column 92. The nozzle represented by a row 96 may fire a color depleted drop in column 91, but will fire a full colorant drop in column 92. The nozzle represented by a row 97 may fire a color depleted drop in column 91, but will fire a full colorant drop in column 92. This will result in a vertical line that is composed of 50% potentially depleted and 50% full colorant drops.

In FIG. 7, higher frequency bursts of ink drops are separated by a period of time equal to approximately three times a length of duration of each higher frequency burst of ink drops. In FIG. 7, in order to avoid depleted pixels when firing a thin horizontal line, it is necessary to horizontally position lines so that nozzles fire a two drop burst for every printed pixel.

Figure 8:
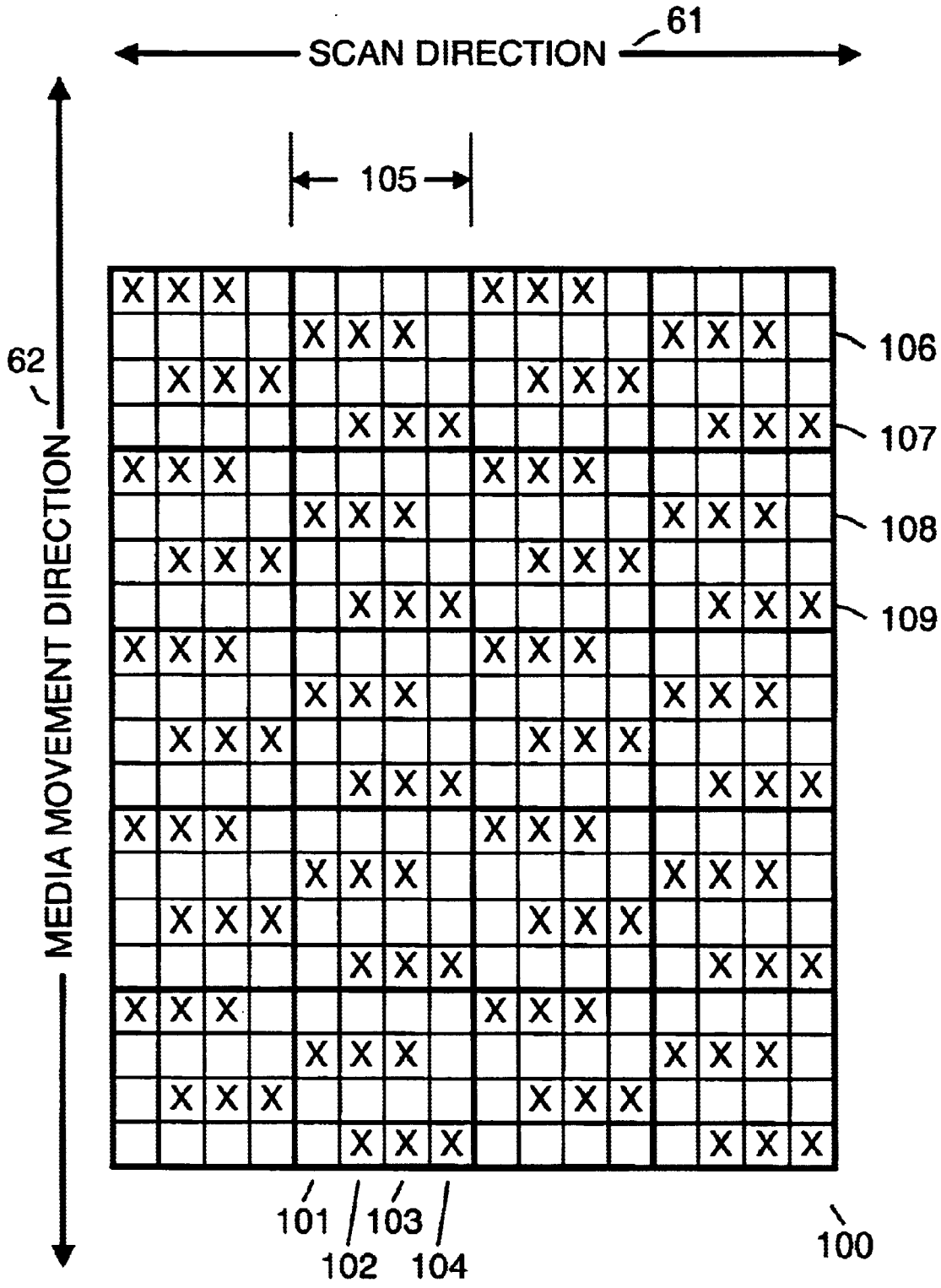
FIG. 8 shows a print mask used within the inkjet printer shown in FIG. 1 in accordance with an embodiment of the present invention.

Burst lengths greater than two may also be used. For example, FIG. 8 shows how good line quality (1/3 potentially depleted drops and 2/3 full colorant drops) can be achieved using a 3 drop burst with a 12 ng, 2400 npi writing system. In order to print a 1/300 inch wide line indicated by width 105, drops in a column 101, a column 102, a column 103 and a column 104 are used. Within width 105, half the nozzles are fired three times per pass. If the nozzles used to print the line delineated by width 105 are idle for a significant length of time (e.g., more than a one second delay) before beginning to print the line delineated by width 105, color depletion of ink drops can result in color depletion of the first drop fired by the nozzle. However, the second drop and the third drop in the three drop burst fired by the nozzle will not be color depleted.

For example, the nozzle represented by a row 106 may fire a color depleted drop in column 101, but will fire a full colorant drop in column 102 and in column 103. Likewise, the nozzle represented by a row 107 may fire a color depleted drop in column 102, but will fire a full colorant drop in column 103 and column 104. The nozzle represented by a row 108 may fire a color depleted drop in column 101, but will fire a full colorant drop in column 102 and column 103. The nozzle represented by a row 109 may fire a color depleted drop in column 102, but will fire a full colorant drop in column 103 and column 104. This will result in a vertical line that is composed of 1/3 potentially depleted and 2/3 full colorant drops.

Figure 9:
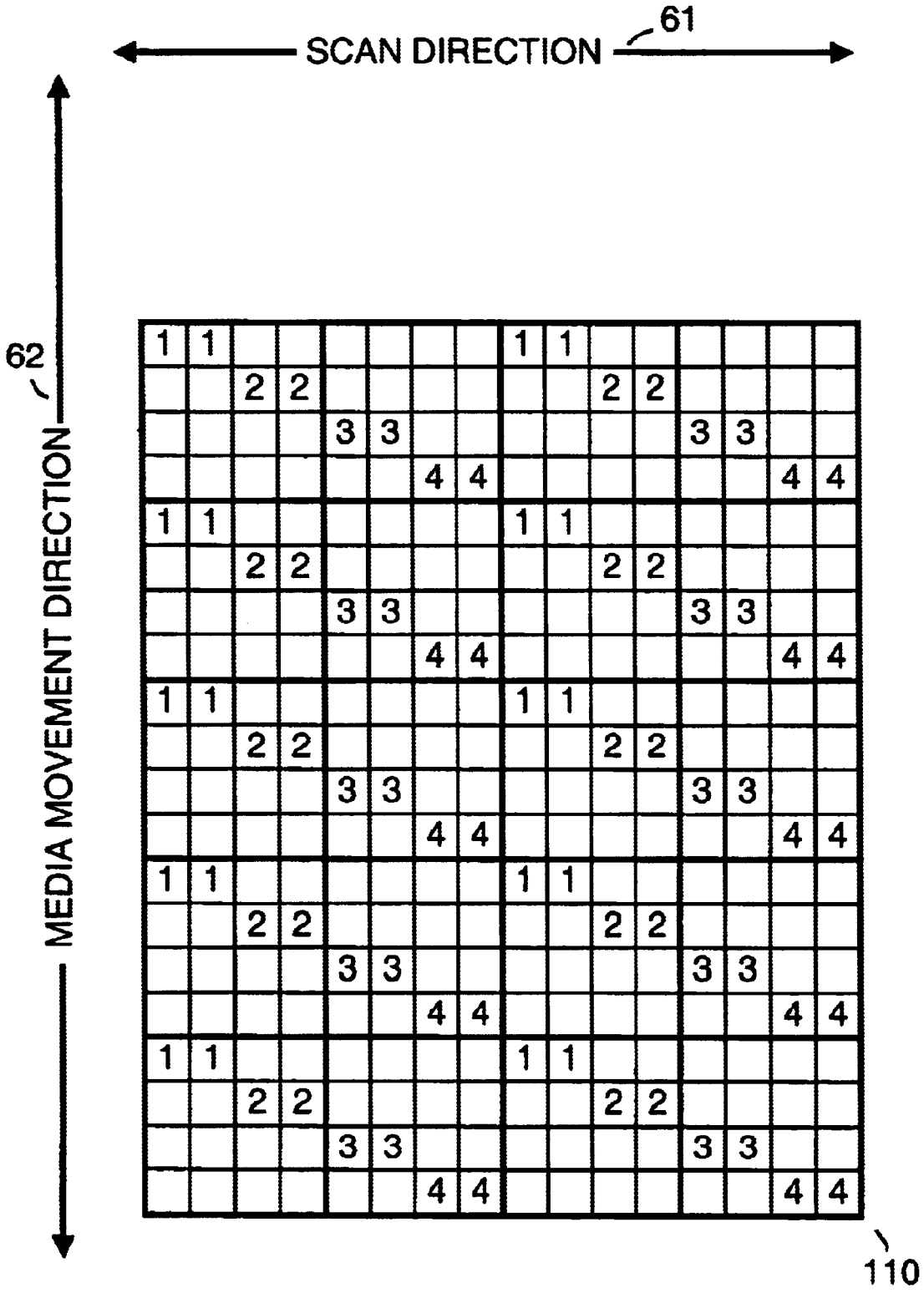
FIG. 9 shows an example of a portion of a printing mask used for four pass printing in accordance with an embodiment of the present invention.

Various embodiments of the present invention can also implemented with multiple pass systems. For example, FIG. 9 shows an example of a portion of a printing mask 110 used for four pass printing with a 2400 nozzles per inch (npi), 18 nanogram (ng) print cartridge. Each small rectangle represents a 1/1200 inch wide by 1/2400 inch tall pixel. A number in a rectangle indicates the number of the pass in which a drop is made on the media. The printing mask shown in FIG. 9 includes two drop burst firing of nozzles. Any 1/600 inch wide line of printing mask 110 will be composed of 50% potentially depleted and 50% full colorant drops. In FIG. 9, the horizontal resolution of printing is 600 dpi, so each nozzle will fire a two drop burst for every printed pixel.

Figure 10:
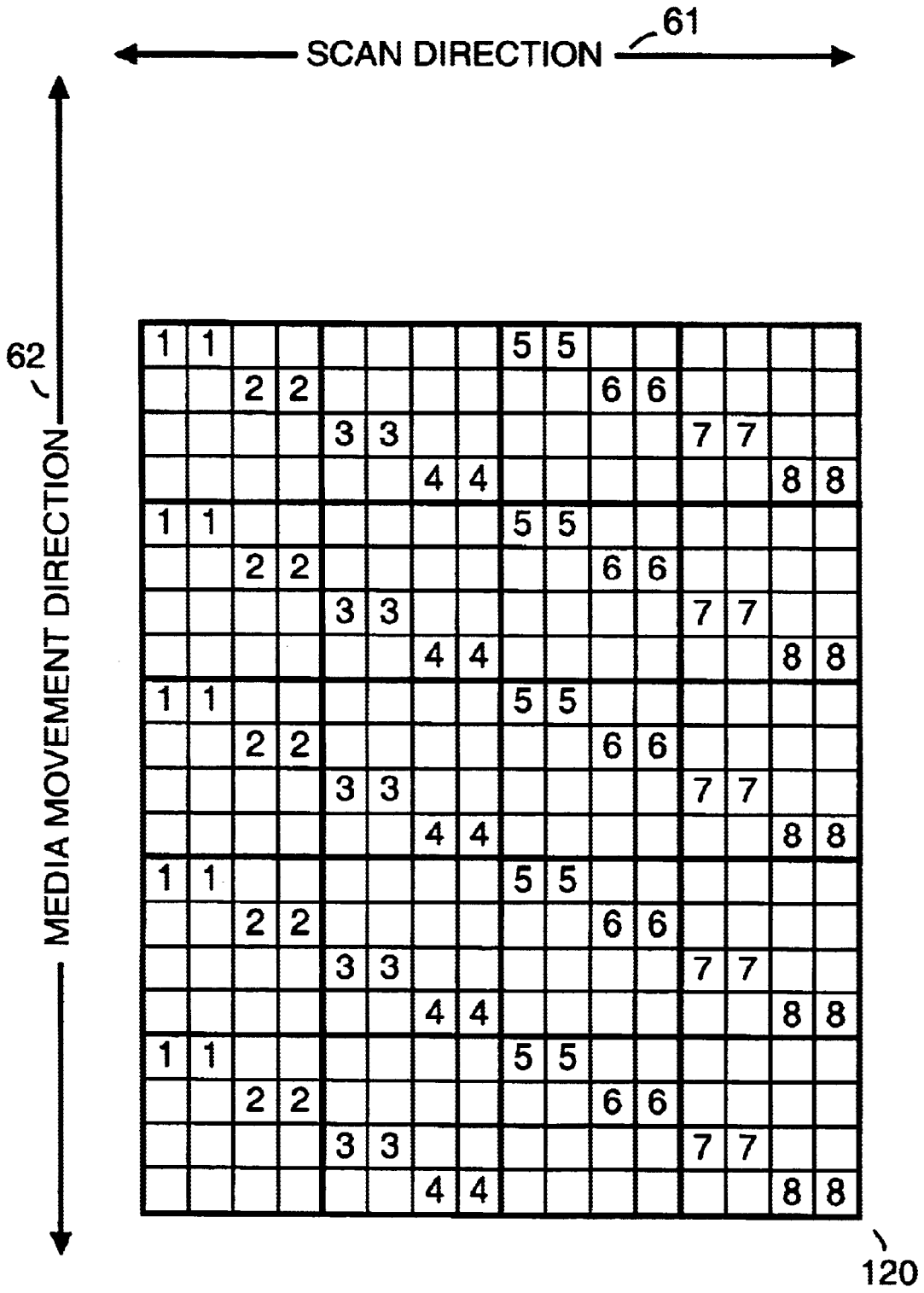
FIG. 10 shows an example of a portion of a printing mask used for eight pass printing in accordance with an embodiment of the present invention.

Likewise, FIG. 10 shows an example of a portion of a printing mask 120 used for eight pass printing with a 2400 nozzles per inch (npi), 18 nanogram (ng) print cartridge. Each small rectangle represents a 1/1200 inch wide by 1/2400 inch tall pixel. A number in a rectangle indicates the number of the pass in which a drop is made on the media. The printing mask shown in FIG. 10 includes two drop burst firing of nozzles. Any 1/600 inch wide line of printing mask 110 will be composed of 50% potentially depleted and 50% full colorant drops. In FIG. 10, the horizontal resolution of printing is 600 dpi, so each nozzle will fire a two drop burst for every printed pixel.

While the present invention was described as used within ink jet printer 10, the present invention can be embodied in other printing systems, for example, such as those that utilize a drum printer or a stationary page wide array. The disclosed embodiments of the present invention can be used to overcome the text, line and image quality problems, associated with colorant migration in low drop weight, high npi writing systems.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

We claim:

1. A method for printing, the method comprising:

compensating for color migration within ink drops by varying firing frequency of each print nozzle so that each print nozzle fires bursts of immediately successive ink drops, delay between firing ink drops within each burst being shorter than delay between firing a last ink drop in each burst and a first ink drop in each following burst.

2. A method as in claim 1 wherein each burst of ink drops includes firing two ink drops.

3. A method as in claim 1 wherein each burst of ink drops includes firing three ink drops.

4. A method as in claim 1 wherein a print mask is used to control timing of the bursts of ink drops.

5. A method as in claim 1 wherein each drop is at most 18 nanograms.

6. A method as in claim 1 wherein for each print nozzle, bursts of ink drops are separated by a period of time approximately equal to three times a length of duration of each burst of ink drops.

7. A method as in claim 1 wherein for each print nozzle, bursts of ink drops are separated by a period of time approximately equal to seven times a length of duration of each burst of ink drops.

8. A method as in claim 1 wherein for each print nozzle, bursts of ink drops are separated by a period of time approximately equal to one and two thirds times a length of duration of each burst of ink drops.

9. A method as in claim 1 wherein printing is performed using single pass mode.

10. A method as in claim 1 wherein printing is performed using a multiple pass mode.

11. A method as in claim 10 wherein printing is performed using a mode with at least four passes.

12. A method as in claim 1 wherein the higher frequency bursts of ink drops are fired at 36 kilohertz.

13. A method as in claim 1 wherein nozzle resolution is at least twice pixel resolution in the horizontal direction.

14. A printer comprising:

a printhead, the printhead including a plurality of print nozzles; and, printer electronics used to control firing frequency of the print nozzles, wherein the printer electronics compensates for color migration within ink drops by varying firing frequency of each print nozzle so that each print nozzle fires bursts of immediately successive ink drops, each print nozzle not being used to fire ink drops between bursts of ink drops.

15. A printer as in claim 14 wherein the printer electronics uses a print mask to control timing of the bursts of ink drops.

16. A printer as in claim 15 wherein the print mask is a firing pattern in which each burst or ink drops includes firing two ink drops.

17. A printer as in claim 15 wherein the print mask is a firing pattern in which each burst of ink drops includes firing three ink drops.

18. A printer as in claim 15 wherein the print mask is a firing pattern in which, for each print nozzle, bursts of ink drops are separated by a period of time approximately equal to three times a length of duration of each burst of ink drops.

19. A printer as in claim 15 wherein the print mask is a firing pattern in which, for each print nozzle, bursts of ink drops are separated by a period of time approximately equal to a length of duration of each burst of ink drops.

20. A printer as in claim 15 wherein the print mask is a firing pattern in which, for each print nozzle, bursts of drops are separated by a period of time approximately equal to one and two thirds times a length of duration of each burst of ink drops.

21. A printer as in claim 14 wherein the higher frequency bursts of ink drops are fired at 36 kilohertz.

22. A printer as in claim 14 wherein print nozzles on the printhead are arranged in four vertical columns with an effective vertical spacing between nozzles of $1/2400^{th}$ inch.

23. A printer comprising:

a printhead means for printing an image, including:

a plurality of nozzle means for ejecting ink drops; and, printer electronics means for controlling firing frequency of the plurality of nozzle means, wherein the printer electronics means compensates for color migration within ink drop by varying firing frequency of each nozzle means so that each nozzle means fires bursts of immediately successive ink drops, each nozzle means not being used to fire ink drops between bursts of ink drops.

24. Storage media that stores a program, which when executed performs, a method comprising:

compensating for color migration within ink drops by varying firing frequency of each print nozzle so that each print nozzle fires bursts of immediately successive ink drops delay between firing ink drops within each burst being shorter than delay between firing a last ink drop in each burst and a first ink drop in each following burst.

25. Storage media as in claim 24 wherein each burst of ink drops includes firing two ink drops.

26. Storage media as in claim 24 wherein each burst of ink drops includes firing three ink drops.

27. Storage media as in claim 24 wherein a print mask is used to control timing of the bursts of ink drops.

28. A method to compensate for color migration within ink drops used in a printing process, the method comprising:

controlling firing frequency of print nozzles in a printer, including the following:

firing higher frequency bursts of immediately successive ink drops from each print nozzle;

not using print nozzles to fire ink drops between higher frequency bursts of ink drops.

29. A method as in claim 28 wherein a print mask is used to control timing of the higher frequency bursts of ink drops.

30. A method as in claim 28 wherein each drop is at most 18 nanograms.

31. A method as in claim 28 wherein for each print nozzle, higher frequency bursts of ink drops are separated by a period of time approximately equal to three times a length of duration of each higher frequency burst of ink drops.

* * * * *

UNITED STATES PATENT AND TRADEMARK OFFICE

CERTIFICATE OF CORRECTION

PATENT NO. : 6,739,684 B1
DATED : May 25, 2004
INVENTOR(S) : Askeland et al.

It is certified that error appears in the above-identified patent and that said Letters Patent is hereby corrected as shown below:

Column 9,
Line 44, after “bursts of” and before “drops” insert -- ink --;

Column 10,
Line 10, delete “drop” and insert in lieu thereof -- drops --;
Line 21, insert a comma after “drops”.

Signed and Sealed this

Tenth Day of August, 2004

JON W. DUDAS
*Acting Director of the United States Patent and Trademark Office*